United States Patent [19]

Cottenceau et al.

[11] Patent Number: 4,645,248

[45] Date of Patent: Feb. 24, 1987

[54] DEVICE FOR SELECTING YARNS FOR A KNITTING MACHINE

[75] Inventors: Rémi Cottenceau, Viry, France; Francois Fischer, Carouge, Switzerland

[73] Assignee: H. Stoll G.m.b.H. & Co., Reutlingen, Fed. Rep. of Germany

[21] Appl. No.: 875,865

[22] Filed: Jun. 18, 1986

[30] Foreign Application Priority Data

Jun. 21, 1985 [CH] Switzerland ..... 2647/85

[51] Int. Cl.[4] ..... A01D 59/04

[52] U.S. Cl. ..... 289/2

[58] Field of Search ..... 66/125, 131, 138, 134, 66/140 R, 145 R, 144; 289/2, 18.1; 242/37 A; 28/211

[56] References Cited

U.S. PATENT DOCUMENTS 2,369,539 2/1945 Crandall ..... 28/211
2,885,874 3/1959 Polach ..... 66/140 R
3,373,947 3/1968 Prasil ..... 289/2 X
3,416,824 12/1968 Nolt et al. ..... 289/2
3,867,745 2/1975 Crandall et al. ..... 28/211

*Primary Examiner*—Ronald Feldbaum
*Attorney, Agent, or Firm*—Cushman, Darby & Cushman

[57] ABSTRACT

The yarns to be selected are mounted on a selecting rocker pivoting about an axis and are held by a clipper. The yarn is selected by this rocker and is raised by a lever. A finger performs two turns and forms a closed loop of this yarn. An arc-shaped rod which is integral with an arm mounted so as to oscillate about a shaft brings the yarn being knitted into the open end of the finger. A hook takes the closed loop of yarn while oscillating about a vertical shaft and returning to its initial position. It releases this loop and grips the yarn being knitted which is then cut by the clipper actuated by a finger which is integral with the arm and engages with a cam integral with the axis of the clipper. At the same time, the selected yarn is freed by this clipper.

6 Claims, 6 Drawing Figures

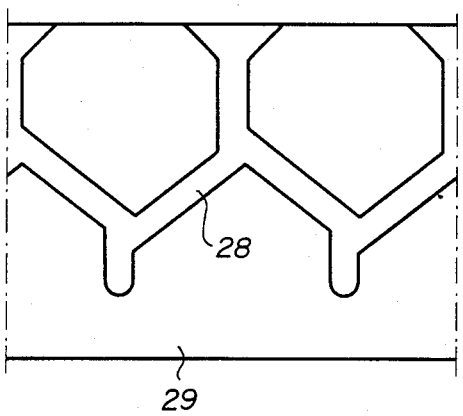
FIG. 5
FIG. 6
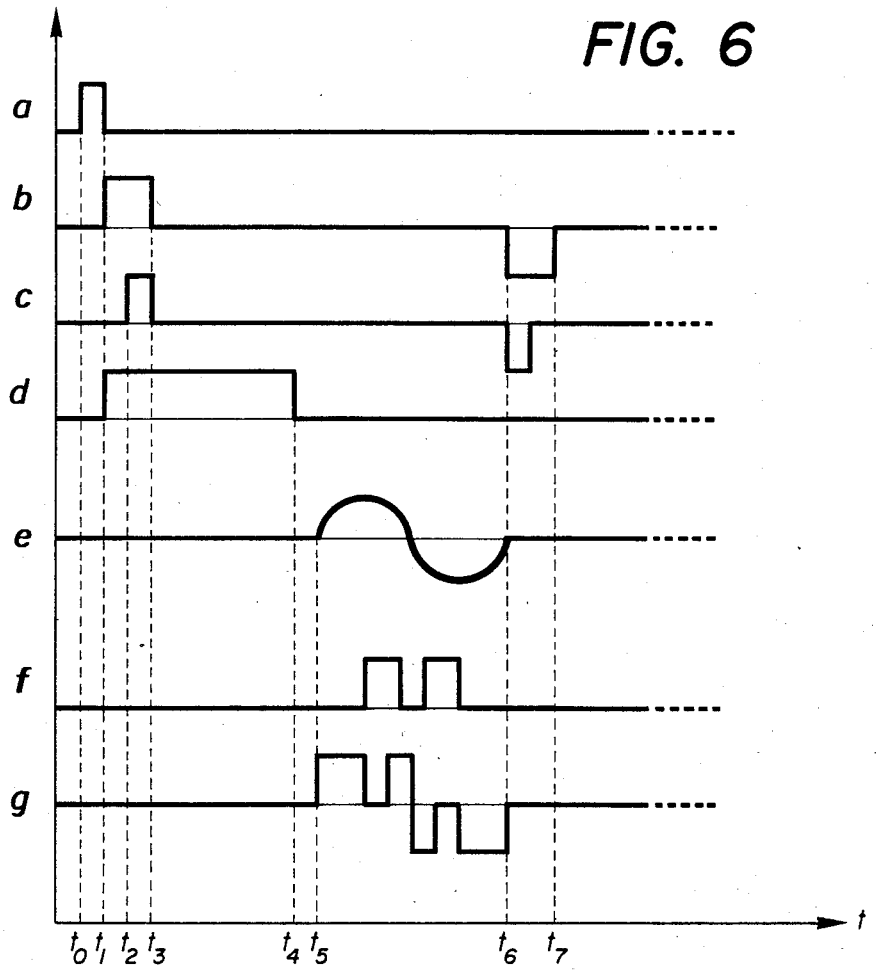

DEVICE FOR SELECTING YARNS FOR A KNITTING MACHINE

The present invention relates to a device for selecting yarns for a knitting machine, comprising means for holding the ends of the yarns to be selected, means for bringing a selected yarn into the path of a closed loop forming member, means for introducing an open loop of the yarn being knitted through said closed loop and means for passing the portion of selected yarn extending between its end and the closed loop through said open loop, means for releasing said closed loop from said rotating member and for gripping it on said selected yarn and means for cutting the yarn being knitted downstream of the gripping point of said closed loop.

Such a device has already been described in GB-A-2,112,423. This device comprises a clipper for each yarn to be selected. In the example described in this document, the number of yarns to be selected is four. If this number is to be increased, for example to be doubled, it is necessary to produce a further device with as many clippers as yarns to be selected. It can easily be understood that the multiplication of these clippers poses problems insofar as each clipper has to be connected to an individual actuating mechanism. The device becomes bulky, it comprises a large number of elements to be assembled and this increases its production and maintenance costs.

The object of the present invention is to simplify this problem considerably, in particular when the device is required for selecting a relatively high number of yarns.

To this end, the present invention relates to a device for selecting yarns for a knitting machine according to claim 1.

The advantages of the device forming the subject of the invention are numerous and reside essentially in the simplification made and in the fact that the same device can accept any number of yarns to be selected with the same clipper mechanism.

Other advantages of this device will appear on reading the following description and on examining the drawings accompanying it.

FIG. 5 is a view of a detail developed along the line VI—VI of FIG. 1.

FIG. 6 is a graph of the various operations as a function of time.

Figure 1:
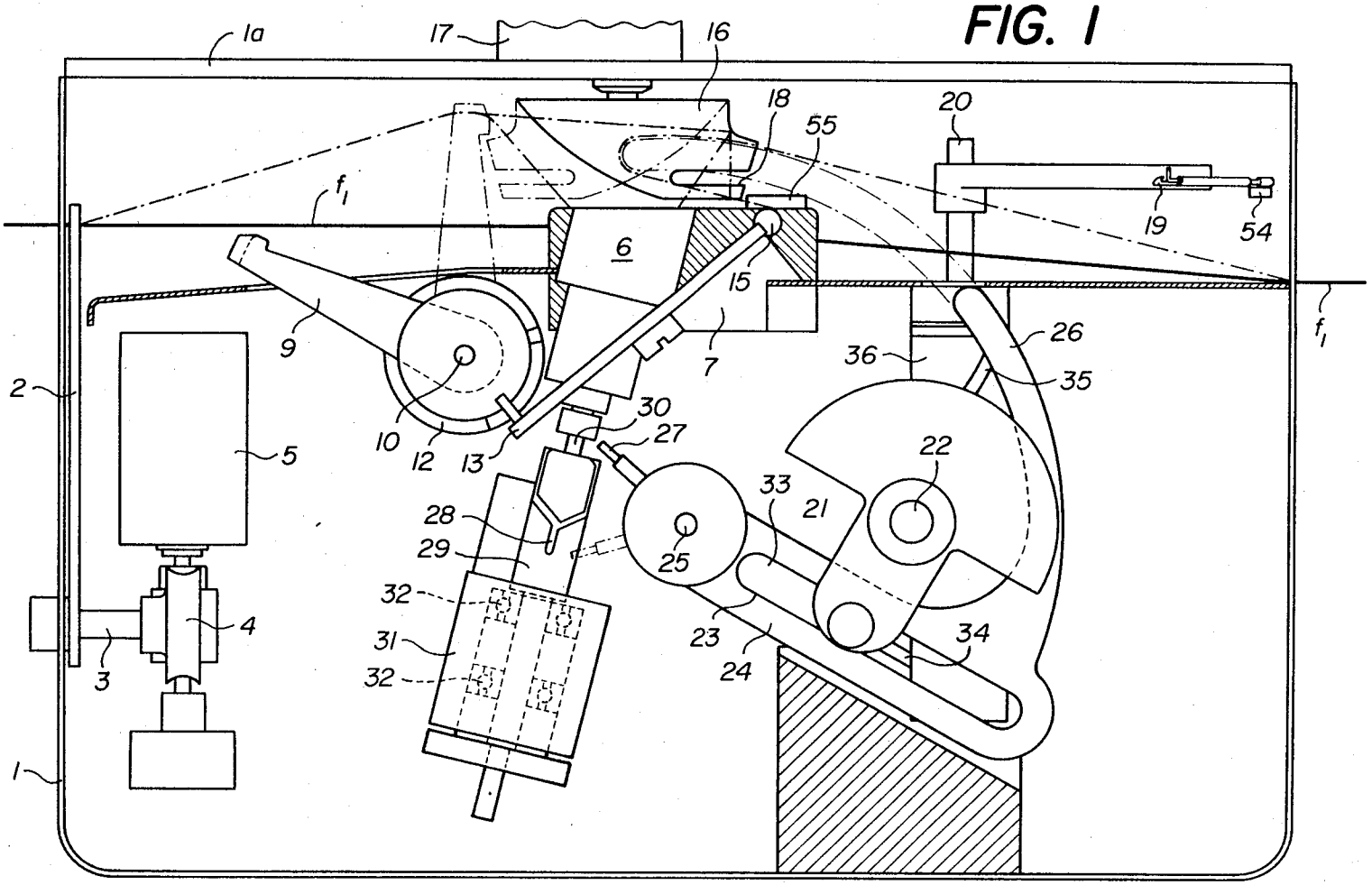
FIG. 1 is an elevation view of the selecting device.
Figure 2:
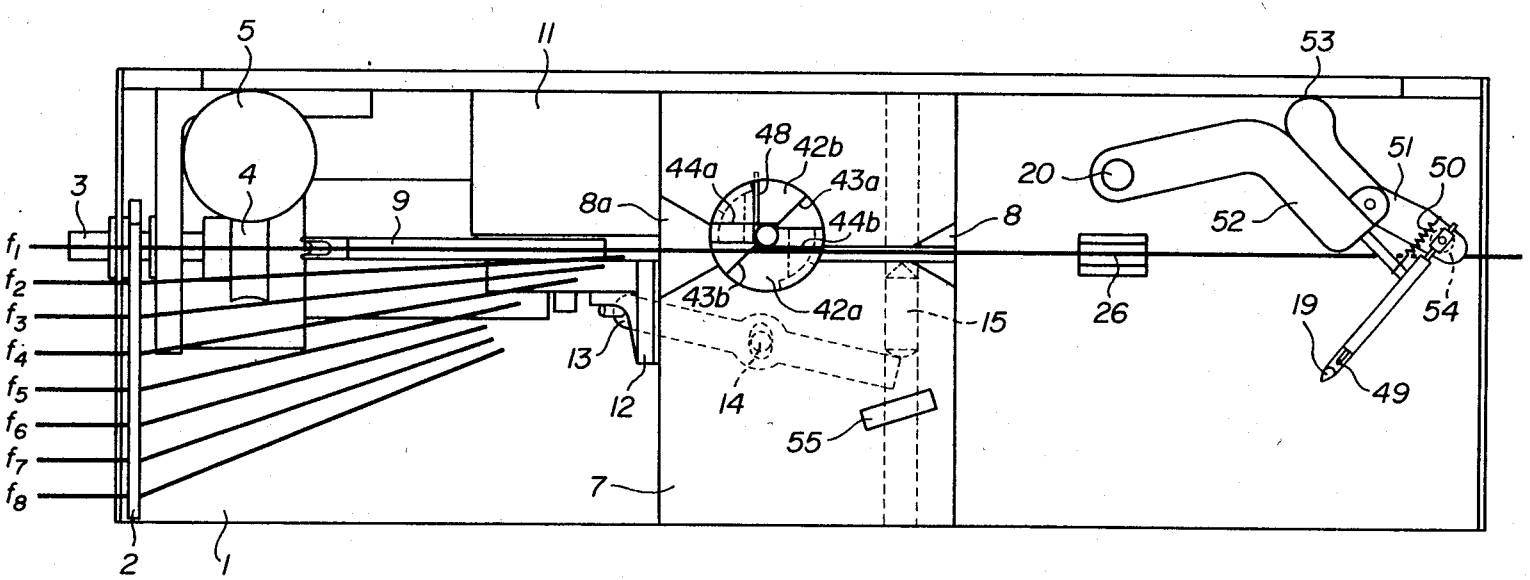
FIG. 2 is a plan view of this device.
Figure 3:
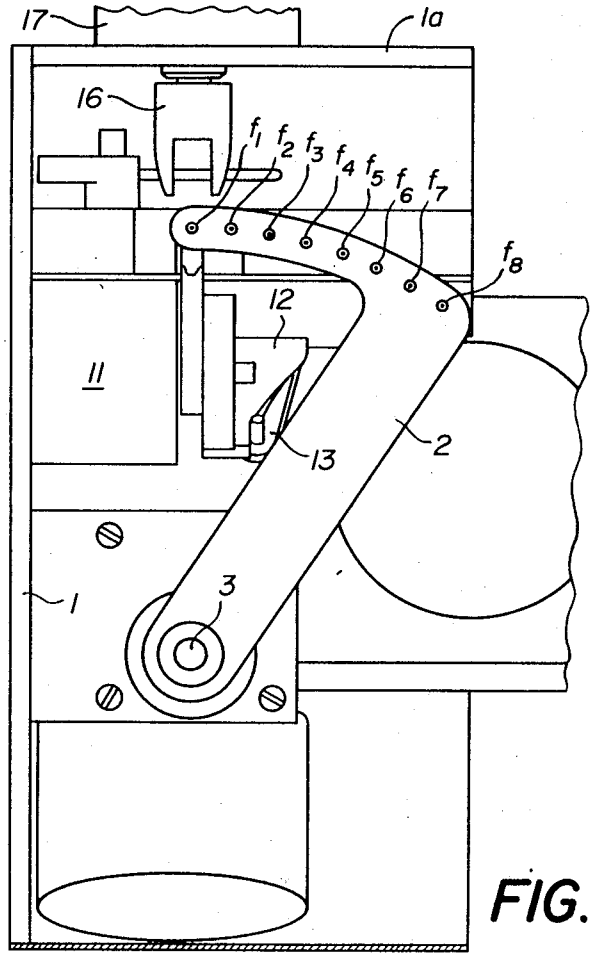
FIG. 3 is a view along the line III—III in FIG. 1.

The device illustrated in FIGS. 1 to 3 is housed in a casing 1. The yarns $f_1$ to $f_8$ to be selected enter the casing through the left-hand side (FIGS. 1 and 2) and the selected yarn leaves it through the right-hand side. Each of the yarns to be selected $f_1$ to $f_8$ passes into one of the eight holes of a selection rocker 2 mounted in oscillating manner on the casing 1 via a shaft 3 which is integral with a pinion 4 engaging with the driving shaft of a motor 5.

The yarns to be selected $f_1$ to $f_8$ converge towards a clipper 6 which will be described in detail hereinafter and is fixed in a supporting plate 7 traversed by a passage 8 opening at its other face and having a widened portion 8*a* for allowing the yarns which are to be selected $f_1$ to $f_8$ access to the clipper 6, the remainder of the passage 8 serving for the exit of the selected yarn which is being knitted.

A lever 9 intended to raise the selected yarn to be knitted is mounted on a pivot shaft 10 actuated by an electromagnet 11. This lever 9 and its shaft 10 are integral with a cam 12 engaging with a rocker 13 mounted so as to oscillate about a pin 14 and intended to move a piston 15 holding the yarn being knitted into the passage 8.

The lower face of the cover 1*a* of the casing 1 bears a finger 16 which is fixed eccentrically to the shaft of a motor 17 integral with the cover of casing 1. As shown in dot-dash lines in FIG. 1, the path of the active end of the finger 16 cuts the yarn raised by the lever 9. This active end is hollow and opens at its external face. A substantially horizontal slot 18 traverses the finger 16 laterally. This slot 18 is designed to permit the passage of a hook 19 mounted so as to oscillate about a vertical shaft 20.

A driving mechanism comprises a crank 21 cottered on a driving shaft 22 and engaging in a groove 23 of an arm 24 mounted so as to oscillate about a horizontal pin 25. The arm 24 has at one end an arc-shaped rod 26 intended to penetrate in the open end of the finger 16, as illustrated in dot-dash lines, and at the other end a driving finger 27 intended to come into engagement with a cam 28 formed in a tubular portion 29 of a driving shaft 30 coupled to the clipper 6 and mounted in a support means 31 by means of rolling bearings 32. The developed cam 28 is illustrated in FIG. 5. It extends over 360° about the axis of the driving shaft 30. During each turn of the crank 21, the arm 24 performs an oscillation having an amplitude of 60° about the horizontal pin 25. During this oscillation, the driving finger 27 engaging with the cam 28 causes the driving shaft 30 of the clipper 6 to perform two successive angular movements in the same direction of 90°.

A second arm 33 equipped with a driving finger 34 is integral with the horizontal pin 25. The driving finger 34 is in engagement with a cam 35 formed in the tubular portion 36 integral with the vertical shaft 20 of the hook 19.

Figure 4:
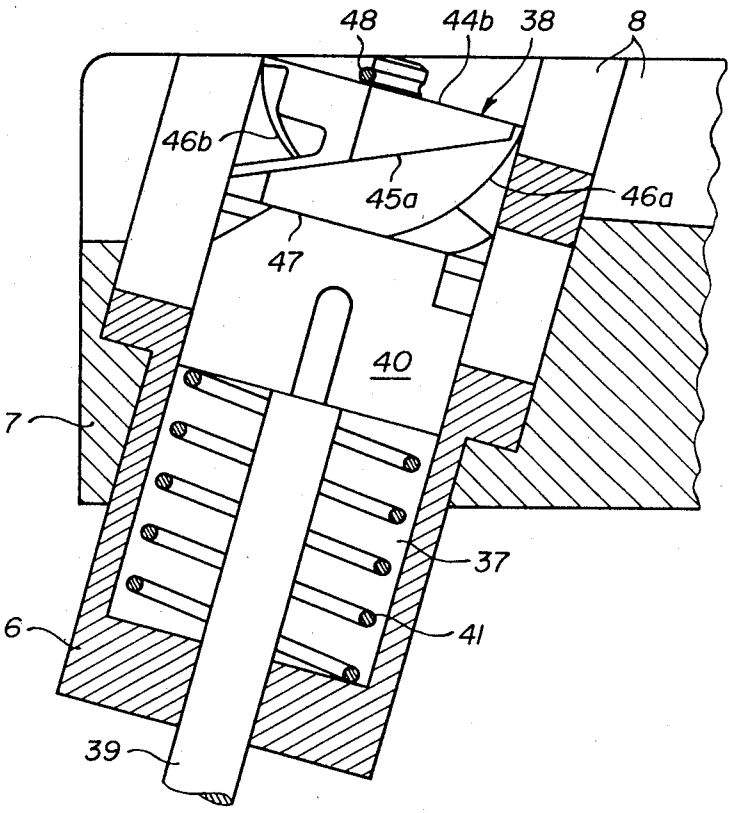
FIG. 4 is a view of a magnified detail along the line IV—IV in FIG. 1.

The clipper 6 comprises, as shown in detail in FIG. 4, a cylindrical housing 37 which receives a first cylindrical member 38 cottered on a shaft 39 in engagement with the driving shaft 30 (FIG. 1). A second member 40 which is annular, is fixed relative to the shaft 39 and is concentric to its axis is pressed against the first cylindrical member 38 by a spring 41 which rests against the base of the cylindrical housing 37.

It should again be noted that the axis of the clipper 6 is inclined and forms an acute angle of approximately 15° with the vertical. This axis is located in a vertical plane parallel to the path of the yarn being knitted.

The first cylindrical member 38 has two symmetrical sectors 42*a*, 42*b* defined by two faces 43*a*, 43*b* located on the same diameter and by two portions of parallel chords 44*a*, 44*b* located on either side of the same diameter, which forms an angle of 45° with the faces 43*a*, 43*b*.

Each symmetrical sector has an oblique upper face 45*a*, 45*b* and a helicoidal groove 46*a*, 46*b* in its lateral face. The edge formed by the upper rim of the groove 46*a*, 46*b* forms the yarn cutting edge which is designed to cooperate with the intersection between the passage 8 and the cylindrical housing 37. The second annular member 40 comprises a raised sector 47 which alone comes into contact with the first cylindrical member 38.

The angle formed by this raised sector 47 is smaller than that of the symmetrical sectors 42*a*, 42*b* but greater than the angle of 45° which separates these symmetrical sectors so that when one of these sectors 42*a*, 42*b* leaves the sector 47, the other is already in contact with it. The beginning of this sector 47 coincides with the right-hand side (when observing the direction of advance of the yarn) of the widened portion 8*a* of the passage 8, adjacent to the cylindrical housing 37.

It is necessary to describe the cylindrical member 38 in more detail. To increase the efficiency of the cutting edges of each sector, the diameter of the cylindrical member 38 is approximately 0.05 mm smaller than that of the housing 37 and a spring 48 presses the cylindrical member 38 laterally against the side of the cylindrical housing 37, in the direction of the passage 8, so that the axis of this member is inclined by a few minutes relative to the axis of the cylindrical housing 37 and so that the cutting of the yarn between the cutting edge and the passage rim 8 is improved.

The hook 19 (FIG. 2) comprises a member 49 for gripping the yarn which is mounted in sliding manner and is placed elastically in the gripping position by means of a spring 50 which acts on a rocker 51 articulated to an arm 52 integral with the vertical shaft 20. This rocker 51 bears at one end a rounded abutment surface 53 designed to actuate this rocker 51 against the pressure of the spring 50 at the end of its travel (FIG. 2) coming to rest against one wall of the casing 1. The other end of this rocker 51 has a stud 54 which projects downwards (FIG. 1) and is designed to engage with a cam 55 (FIG. 2) for opening the member for gripping the yarn 49 at the other end of the travel of the hook controlled by the cam 35.

If a yarn is to be changed, the motor 5 is controlled so as to move the selecting rocker 2 so as to bring the selected yarn $f_1$ to $f_8$ into alignment with the lever 9 intended to raise the yarn and with the passage 8. The yarn being knitted, in turn, is moved away from this position and now forms an angle with the passage 8. It continues to travel at the knitting speed in the normal manner. With reference to the diagram in FIG. 6, the time $t_1$ corresponds to the end of travel of the rocker 2 represented by the function a. At this same moment $t_1$, the functions b and d begin, these functions corresponding respectively to the raising of the lever 9 by the electromagnet 11 and the setting into rotation of the finger 16 by the motor 17. Before the end of the functioning of the lever 9, the cam 12 integral with this lever meets the rocker 13 at the moment $t_2$ (function c) which pushes the piston 15 and serves to guide the yarn being knitted into the passage 8.

The finger 16 meets the selected yarn which has just been raised by the selection rocker 2, entrains it, performs two complete revolutions from its initial position illustrated in a continuous line and stops at the moment $t_4$ so that a loop of yarn is formed round this finger 16, the end of this yarn always being gripped between the raised sector 47 of the second member 40 of the clipper 6 and the lower face of the first cylindrical member 38.

Function e of the arm 24 and of its arc-shaped rod 26 begins at moment $t_5$. This function e is controlled by the crank 21 which is cottered on the driving shaft 22. The two other functions f and g are derived from the function g and are structurally linked to it. In fact, the function f is controlled by the driving finger 34 of the second arm 33 integral with the horizontal pin 25 and the function f is controlled by the driving finger 27 engaging with the cam 28. The chronology of these functions is illustrated by the diagram in FIG. 7.

During its travel, the curved rod 26 meets the yarn being knitted and forms an open loop which it introduces into the open end of the finger 16, this yarn being held, furthermore, by the piston 15 which has previously been pushed by the rocker 13. As observed by the position of the curved rod 26 and of the yarn being knitted, which are drawn in dot-dash lines, the yarn passes round the slot 18 made in the finger 16 so that the hook 19 which is moved by the driving finger 34 engaging with the cam 35 of the tubular portion 36 of the shaft 20 penetrates in the slot 18 and hooks the portion of the loop of yarn formed round the finger 16, which passes behind this yarn once the yarn gripping member 49 has been removed by the cam 55.

At this moment, the crank 21 integral with the driving shaft 22*a* performs a rotation of 180° and the driving finger 27 engaging with the cam 28 has moved the cylindrical member 38 of the clipper 6 by 90° (see position in dot-dash lines in FIG. 4). After this 90° rotation of the cylindrical member 38, the end of the selected yarn which is raised by the lever 9 and forms a closed loop round the finger 16 is freed. The crank initiates the second half of its rotation, the curved rod 26 passes from its dot-dash line position to its continuous line position. At the same time, the hook 19 retracts, dragging with it the free end of the selected yarn. At the very beginning of this retraction movement, the stud 54 leaves the cam 55 and the yarn gripping member 49 closes on the yarn and grips it against the hook 19. By performing its rotation about the vertical axis of the shaft 20, the hook 19 causes the loop of selected yarn to slide from the finger 16 and grips it on the yarn being knitted. At the end of the travel of the arm 52 (position in continuous line in FIG. 1), the abutment surface 53 meets the wall of the casing 1 and the rocker 51 releases the yarn gripping member 49. At the same time, the cylindrical member 38 of the clipper 6 performs a second 90° angular movement in the same direction as before, owing to the shape of the cam 28 cooperating with the driving finger 27. It is thus seen that this cam 28 has two symmetrical portions over 360° and that during each complete rotation of the crank 21, the cam 28 actuated by the finger 27 only turns the cylindrical member 38 by a half turn. For this reason this member 38 has two perfectly symmetrical sectors 42*a*, 42*b*, only one of these sectors operating during each yarn changing cycle. FIGS. 2 and 4 show that, since the angular space between two sectors 42*a*, 42*b* is smaller than the raised sector 47 of the second member 40, the ends of the yarns which have not been selected are held constantly between this raised sector 47 and the sectors 42*a*, 42*b* because, before one of these sectors 42*a*, 42*b* leaves the raised sector 37, the other comes into contact with it, ensuring continuity of gripping.

While the cylindrical member 38 performs the second quarter of rotation of the yarn changing cycle, the yarn being knitted is introduced into the helicoidal groove 46*a* or 46*b* and, at the moment of being cut by the cutting edge formed by the upper rim of the groove 46*a* or 46*b* and passing beyond the side of the passage 8 adjacent to the cylindrical housing 37, it is brought through the end of this groove 46*a* or 46*b* adjacent to the raised sector 47 between this sector and the lower face of the cylindrical member 38 between which it is gripped elastically like the other yarns.

Once the closed knot of the selected yarn is gripped in the vicinity of the cut end of the yarn being knitted, the yarn being knitted then drags the selected yarn towards the knitting needles of the machine. The cycle is completed, the raising lever returns to its starting position shown in a continuous line. A further cycle may thus recommence when the yarn is to be changed again.

We claim:

1. A device for selecting yarns for a knitting machine comprising means for holding the ends of the yarns to be selected, means for bringing a selected yarn into the path of a rotating member for forming closed loop, means for introducing an open loop of the yarn being knitted through said closed loop and means for passing the portion of selected yarn extending between its end and the closed loop through said open loop, means for releasing said closed loop from said rotating member and for gripping it on said selected yarn and means for cutting the yearn being knitted upstream of the point where said closed loop is gripped, characterised in that said means for holding the ends of yarns to be selected and for cutting the yarn being knitted comprise a rotatable circular housing arranged in the path of the yarn being knitted and having a lateral opening for the entry of the yarns to be selected and a passage aligned with said path, said circular member being rotatably mounted in the said circular housing, a driving member, a shaft integral with said circular member and connected to said driving member and having two distinct symmetrical sectors on said shaft, circular lateral faces of said sectors which faces comprise two respective helicoidal grooves for guiding an angularly fixed circular member, said helicoidal grooves opening respectively, on the one hand in the face of said rotatable circular member adjacent to said angularly fixed circular member and, on the other hand, in one of the two faces defining said respective sectors, respective cutting edges formed between these respective helicoidal grooves and the circular lateral faces of said respective sectors, an edge formed by the intersection of the rim of that of the walls of the downstream portion of said passage situated opposite the direction of rotation of the rotatable circular member with the wall of said circular housing, said cutting edges cooperating in turns with said edge, said fixed circular member having a face adjacent to said rotatable circular member being pressed elastically against it and having the form of a sector extending over an angular portion of which the angle is smaller than that of said symmetrical sectors but larger than the space separating these same sectors, the beginning of this sector coinciding substantially with said lateral opening for the entry of the yarns to be selected.

2. A device according to claim 1 comprising a drive member arranged to perform an oscillating movement in a plane containing the axis of the rotatable circular member, a circular cam coaxial with the said rotable circular member and shaped so as to convert said oscillating movement of said driving member into a unidirectional rotating movement, each said oscillating movement of said driving member correspond to a said angular movement of $2° \times 90°$, said rotatable circular member being kinematically fast with said circular cam.

3. A device according to claim 2 further comprising an oscillatory shaft, fast with said driving member and with said means for introducing an open loop of the yarn.

4. A device according to claim 2 further comprising a tubular member having a vertical axis, integral with said means for passing the portion of selected yarn through said open loop, a cam formed along said tubular member, a second driving member engaging said cam, said second driving member being fast with said oscillatory shaft.

5. A device according to claim 1, characterised in that the axis of said rotatable circular member forms on acute angle with the vertical and is contained in a vertical plane parallel to the path of the yarn being knitted.

6. A device according to claim 1, in which said rotatable circular member has a certain clearance from the wall of said circular housing and further comprising an elastic element which presses said rotatable circular member against the portion of this wall adjacent to said passage while inclining the axis of said rotatable circular member relative to that of said circular housing.

* * * * *

UNITED STATES PATENT AND TRADEMARK OFFICE

CERTIFICATE OF CORRECTION

PATENT NO. : 4,645,248

DATED : February 24, 1987

INVENTOR(S) : Remi COTTENCEAU, and Francois FISCHER

It is certified that error appears in the above-identified patent and that said Letters Patent is hereby corrected as shown below:

IN THE CLAIMS:

Claim 1, column 5, line 19, change "selected yarn" to read --yarn being knitted--.

Signed and Sealed this

Twenty-eighth Day of February, 1989

*Attest:*

DONALD J. QUIGG

*Attesting Officer*

*Commissioner of Patents and Trademarks*